US005222308A

United States Patent [19]

Barker et al.

[11] Patent Number: 5,222,308

[45] Date of Patent: Jun. 29, 1993

[54] BOOT DRYING APPARATUS

[76] Inventors: Calvin Barker; Patricia A. Barker, both of 5980 Hwy. 17, Plymouth, Ind. 46563

[21] Appl. No.: 905,678

[22] Filed: Jun. 29, 1992

[51] Int. Cl.[5] ..... F26B 25/00

[52] U.S. Cl. ..... 34/104; 34/239

[58] Field of Search ..... 34/103, 104, 105, 239, 34/240, 106, 107, 21

[56] References Cited

U.S. PATENT DOCUMENTS

| | | | |
|---|---|---|---|
| 3,513,564 | 5/1970 | Gramprie | 34/104 |
| 3,645,009 | 2/1972 | Ketchum | 34/104 |
| 3,793,744 | 2/1974 | Saita | 34/104 |
| 3,798,788 | 3/1974 | Kuntz | 34/104 |
| 4,085,519 | 4/1978 | Masika | 34/104 |
| 4,136,464 | 1/1979 | Hay | 34/104 |
| 4,200,993 | 5/1980 | Blanc et al. | 34/104 |
| 4,768,293 | 9/1988 | Kaffka | 34/104 |
| 5,003,707 | 4/1991 | Chu | 34/104 |

FOREIGN PATENT DOCUMENTS

| | | | |
|---|---|---|---|
| 183680 | 11/1955 | Fed. Rep. of Germany | 34/104 |
| 1320076 | 1/1963 | France | 34/104 |

*Primary Examiner*—Henry A. Bennet
*Assistant Examiner*—Denise L. Gromada
*Attorney, Agent, or Firm*—Leon Gilden

[57] ABSTRACT

A manifold mounts a plurality of drying manifolds thereon, wherein the manifold tube includes a delivery conduit permitting selective removal and additional positioning of drying manifolds relative to the primary manifold tube. Each drying manifold includes a plurality of L-shaped tubular legs to project drying air into the toe region of each boot positioned upon the legs.

2 Claims, 4 Drawing Sheets

BOOT DRYING APPARATUS

BACKGROUND OF THE INVENTION

1. Field of the Invention

The field of invention relates to boot drying structure, and more particularly pertains to a new and improved boot drying apparatus wherein the same is arranged to accommodate in an adjustable manner plural pairs of boots thereon.

2. Description of the Prior Art

To reduce difficulties and disadvantages of prior art boot drying structure, typically of a bulky and complex organization, the instant invention addresses deficiencies thereof by providing not only a compact and efficient structure, but further includes an organization permitting ease of expansion to accommodate greater number of boot pairs to be dried. Prior art structure as typified in the prior art is exemplified by the U.S. Pat. Nos. 4,768,293; U.S. Pat. No. Des. 310,742; 3,867,611; 4,908,957; and 4,787,153.

Accordingly, there remains a need for a new and improved boot drying apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of boot drying apparatus now present in the prior art, the present invention provides a boot drying apparatus wherein the same provides plural pairs of boot drying manifolds, each having plural L-shaped legs to direct air interiorly of each boot cavity. As such, the general purpose of the present invention, which will be described subsequently in greater detail, is to provide a new and improved boot drying apparatus which has all the advantages of the prior art boot drying apparatus and none of the disadvantages.

To attain this, the present invention provides a manifold mounting a plurality of drying manifolds thereon, wherein the manifold tube includes a delivery conduit permitting selective removal and additional positioning of drying manifolds relative to the primary manifold tube. Each drying manifold includes a plurality of L-shaped tubular legs to project drying air into the toe region of each boot positioned upon the legs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boot drying apparatus which has all the advantages of the prior art boot drying apparatus and none of the disadvantages.

It is another object of the present invention to provide a new and improved boot drying apparatus which may be easily and efficiently manufactured and marketed.

It is a further object of the present invention to provide a new and improved boot drying apparatus which is of a durable and reliable construction.

An even further object of the present invention is to provide a new and improved boot drying apparatus which is susceptible of a low cost of manufacture with regard to both materials and labor, and which accordingly is then susceptible of low prices of sale to the consuming public, thereby making such boot drying apparatus economically available to the buying public.

Still yet another object of the present invention is to provide a new and improved boot drying apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic cross-sectional illustration of a prior art boot drying apparatus.

FIG. 2 is an isometric illustration of a further example of a boot drying structure.

DESCRIPTION OF THE PREFERRED EMBODIMENT

Figure 5:
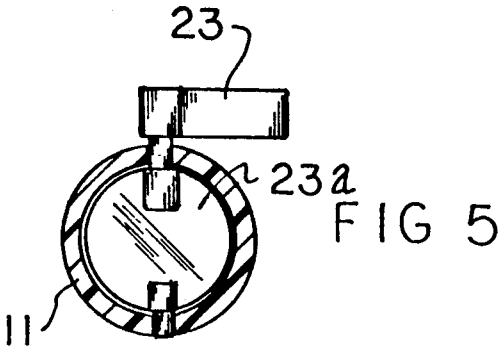
FIG. 5 is an orthographic view, taken along the lines 5—5 of FIG. 4 in the direction indicated by the arrows.

With reference now to the drawings, and in particular to FIGS. 1 to 6 thereof, a new and improved boot drying apparatus embodying the principles and concepts of the present invention and generally designated by the reference numeral 10 will be described.

FIG. 1 is a cross-sectional illustration of U.S. Pat. No. 4,768,293 illustrating a conventional boot member mounted upon prior art boot drying structure. FIG. 2 illustrates a boot and shoe dryer structure, as set forth in U.S. Pat. No. Des. 310,742.

Figure 6:
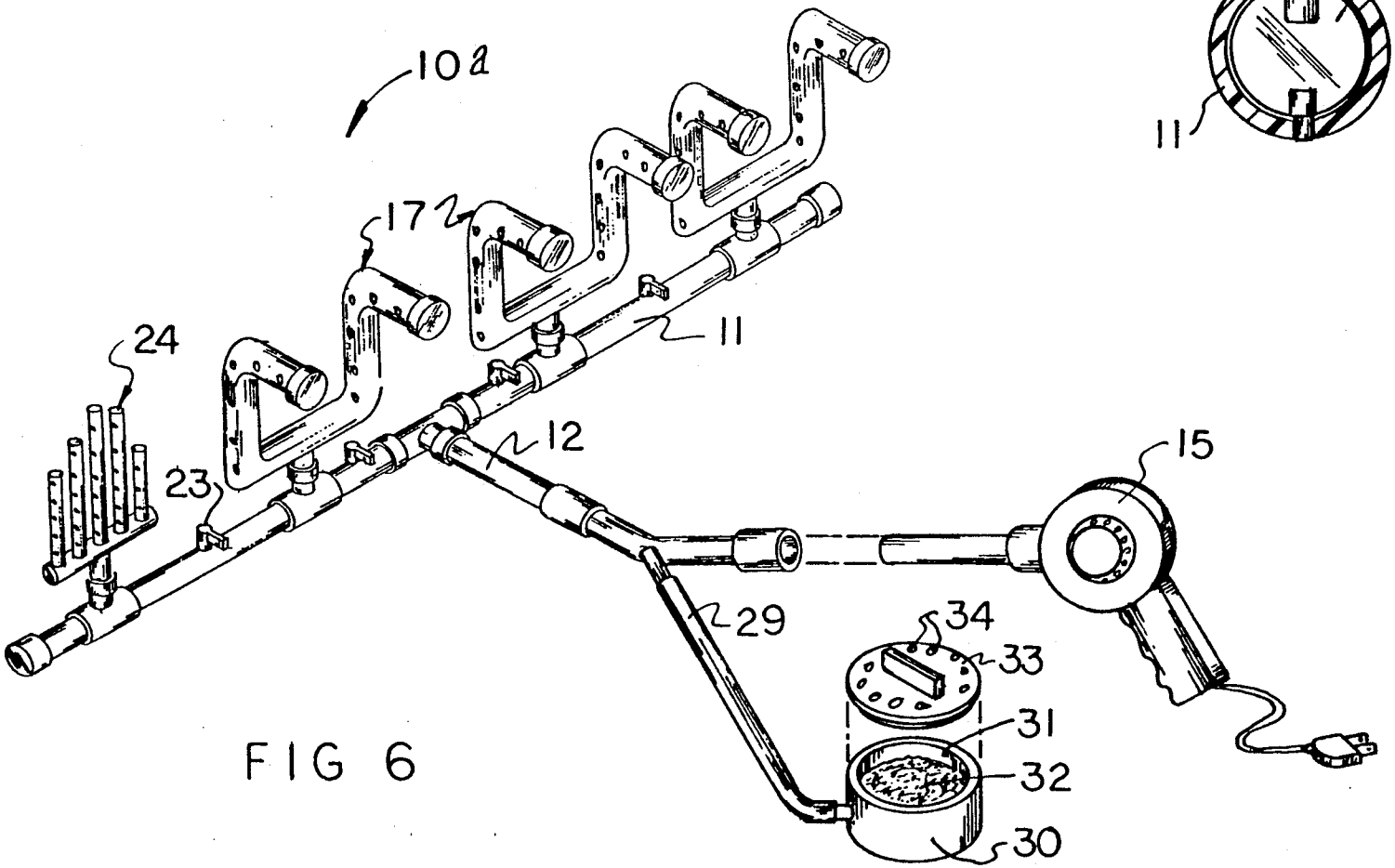
FIG. 6 is an isometric illustration of a modified aspect of the invention.
Figure 3:
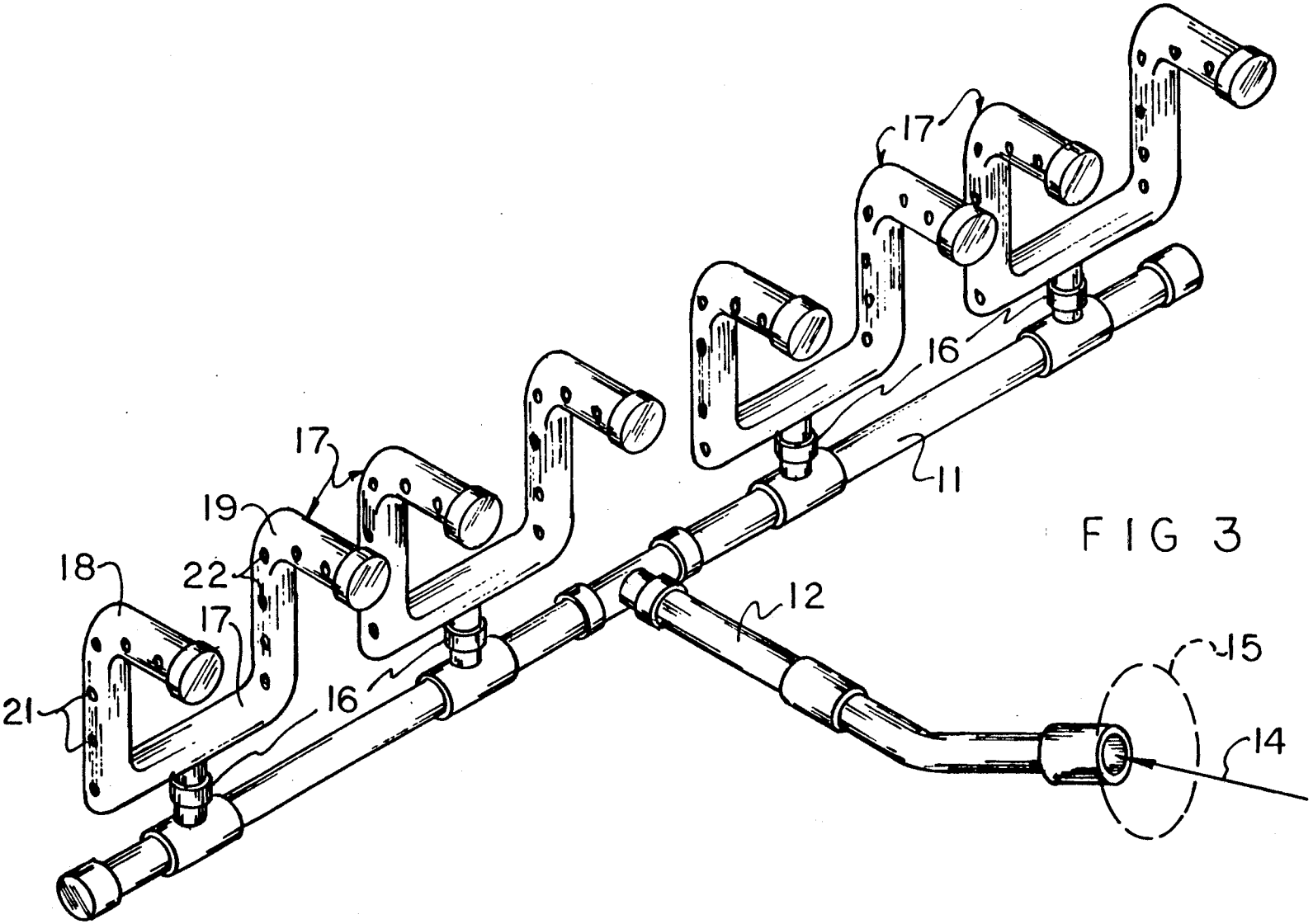
FIG. 3 is an isometric illustration of the invention.

More specifically, the boot drying apparatus 10 of the instant invention essentially comprises a manifold tube 11, including a delivery conduit 12 intersecting in pneumatic communication with the manifold tube 11. The delivery conduit 12 includes a conduit entrance 13 accommodating drying air flow 14 from a drying air unit 15, as illustrated in phantom and as illustrated in FIG. 6, to employ either heated or non-heated drying air flow 14 directed into the conduit entrance 13.

The manifold tube 11 includes a plurality of manifold couplings 16 removably mounting drying manifold 17 thereto. Each drying manifold 17 includes a base conduit 18 having a base conduit connector 18*a* in selective securement to an associated coupling 16. Each base conduit 18 further includes a respective first and second L-shaped tubular leg 19 and 20 having respective first and second apertures 21 and 22 directed therethrough to direct the drying air flow 14 from the delivery conduit 12 through the manifold tube 11 and into the respective first and second tubular legs 19 and 20.

Figure 4:
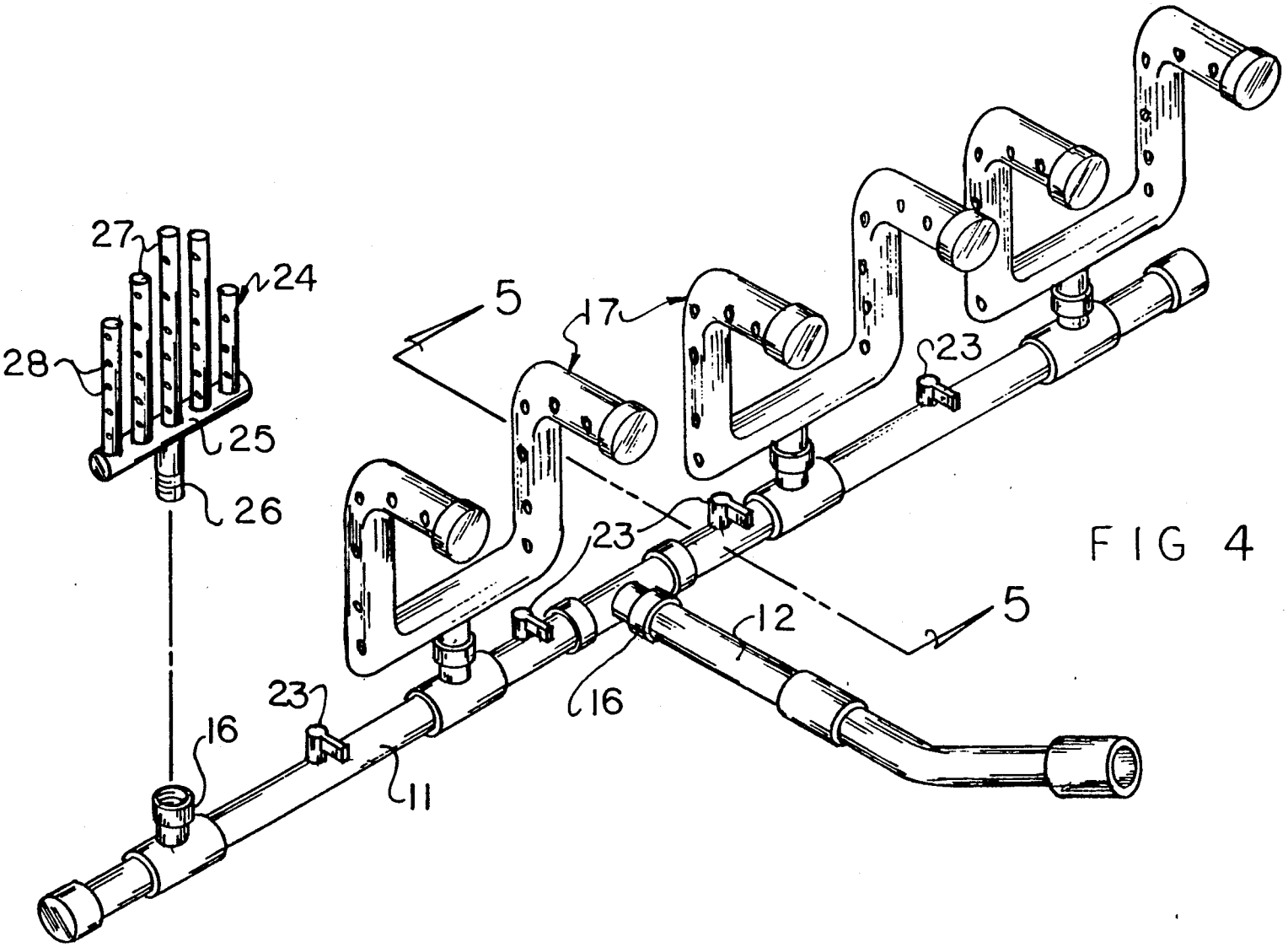
FIG. 4 is an isometric illustration of the invention employing a glove drying manifold.
Figure 5:
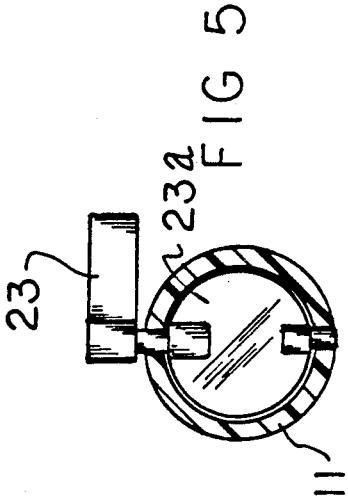
Figure 6:
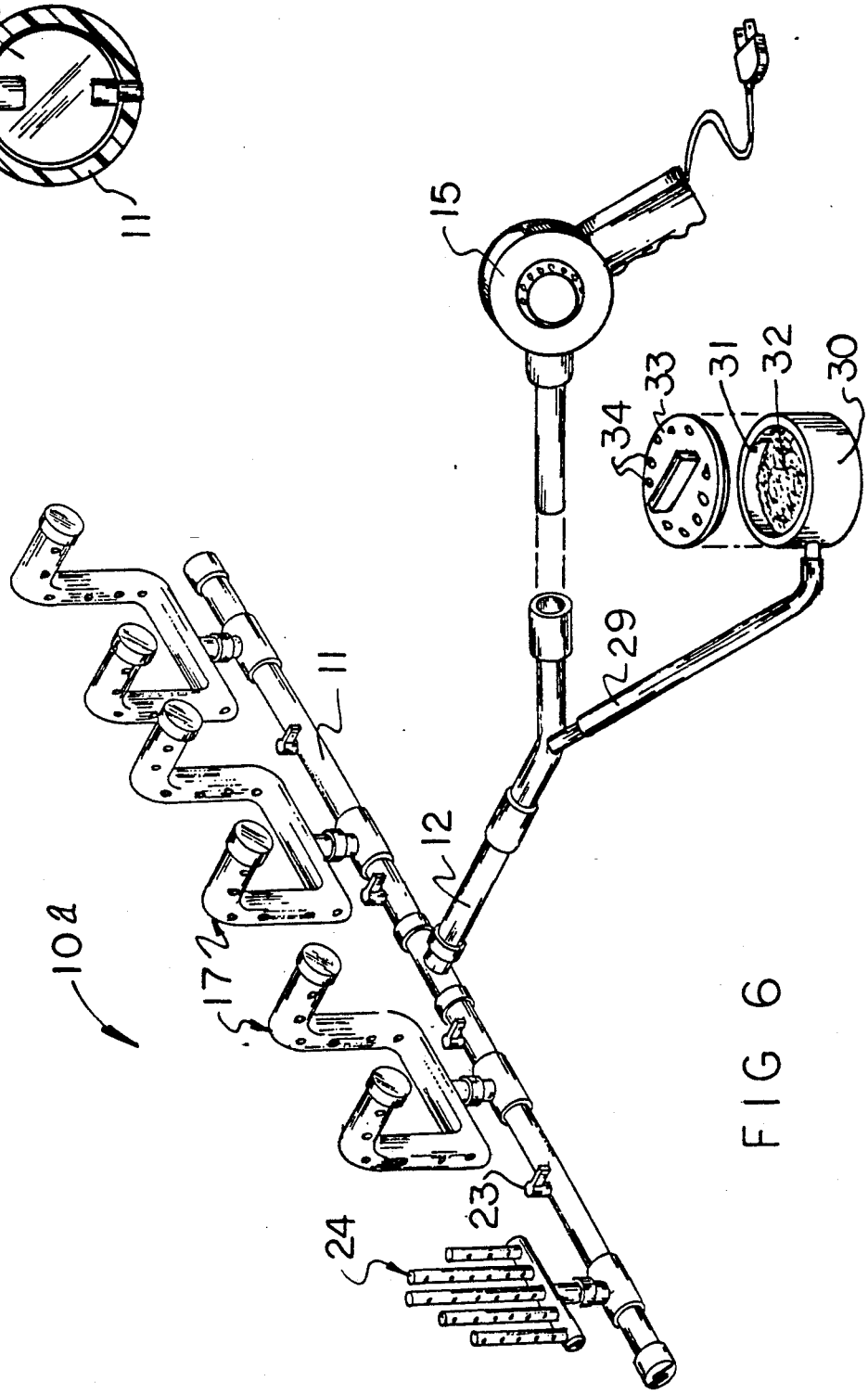

As illustrated in FIG. 4 for example, positioned between adjacent manifold couplings 16 is a valve member 23, as well as the coupling 16 directed to the delivery conduit 12. It should be further noted that the manifold tube 11 includes end caps removably mounted from the manifold tube at the distal ends of the manifold tube to permit additional lengths of manifold tube to accommodate additional drying manifolds 17 thereon.

The valve member 23 includes a valve plate 23*a* (see FIG. 5) pivotally mounted within the manifold tube 11.

The manifold coupling 16 permits accommodating a glove drying manifold 24 thereon, as illustrated in FIG. 4. The glove drying manifold 24 includes a base tube 25 having a base tube connector 26 directed into the coupling 16 in a removable manner. The base tube 25 is also in pneumatic communication with a plurality of finger tubes 27. Five such finger tubes are utilized and the five finger tubes are of varying heights to accommodate varying lengths typically associated with the human anatomy and of glove construction. The finger tubes 27 each include a plurality of finger tube apertures 28 to direct drying air from the manifold tube 11 into an associated glove (not shown) mounted on the drying manifold 17. It should be noted that a plurality of such glove drying manifolds 24 may be utilized, wherein for purposes of illustration, only one such manifold is illustrated mounted to an associated coupling 16.

The FIG. 6 illustrates the apparatus 10*a* to further include a venturi tube 29 pneumatically intersecting the delivery conduit 12 at an acute angle to provide lamina air flow from a support container 30 having a support container cavity 31. The support container cavity 31 includes an anhydrous power 32 contained therewithin. The container lid 33 is mounted to an upper distal end of the support container 30, with the container lid 33 having a plurality of lid vent apertures 34 directed therethrough to direct air from the vent apertures 34 to accommodate venting and air flow of the powder 32 into the delivery conduit 12 and subsequently into boot members (not shown) of a type as illustrated in FIG. 1, and to further permit the directing of such drying powder into glove structure positioned upon the glove drying manifold structure 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boot drying apparatus, comprising, an elongate manifold tube, the manifold tube having a first end and a second end, and the first end and the second end each including a respective removable cap mounted thereto, and the manifold tube including a plurality of manifold couplings, wherein one of said manifold couplings includes a delivery conduit mounted thereto, the delivery conduit is directed from the manifold tube in pneumatic communication therethrough at least one manifold coupling, and further manifold couplings of said manifold couplings each include a manifold securable thereto, and the delivery conduit including a delivery conduit entrance, the delivery conduit entrance including a drying air unit mounted thereto to direct drying air through the delivery conduit into each drying manifold through the manifold tube, and each drying manifold includes a base conduit, and the base conduit including a first tubular leg spaced from a second tubular leg, wherein the first tubular leg includes a plurality of first apertures, and the second tubular leg includes a plurality of second apertures to direct said drying air flow from the first tubular leg and the second tubular leg, and the first tubular leg and the second tubular leg are each configured of an L-shaped configuration coextensive relative to one another, and at least one drying manifold is removably mounted relative to one further manifold coupling of said further manifold couplings, and a glove drying manifold, the glove drying manifold including a base tube, the base tube including a base tube connector securable to said at least one further manifold coupling, and the base tube including a plurality of parallel finger tubes, the parallel finger tubes of varying lengths, and each of the finger tubes including finger tube apertures directed therethrough to direct said drying air flow through the finger tube apertures.

2. An apparatus as set forth in claim 1 wherein the delivery conduit includes a venturi tube, the venturi tube in pneumatic communication with the delivery conduit defining an acute included angle between the venturi tube and the delivery conduit, and the venturi tube including a venturi tube first end secured to the delivery conduit, the venturi tube secured to the second end, and a support container, the support container including a support container cavity, and the venturi tube second end secured to the support container cavity in pneumatic communication with the support container cavity, the support container cavity including an anhydrous powder contained therewithin, and a container lid securable to the support container, the container lid including container lid vent apertures directed therethrough.

* * * * *